US007223134B2

(12) United States Patent
Chaillot

(10) Patent No.: US 7,223,134 B2
(45) Date of Patent: May 29, 2007

(54) FEMALE ELECTRIC CONTACT

(75) Inventor: Georges Chaillot, Nogent le Roi (FR)

(73) Assignee: FCI, Versailles (FR)

( * ) Notice: Subject to any disclaimer, the term of this patent is extended or adjusted under 35 U.S.C. 154(b) by 94 days.

(21) Appl. No.: 10/481,930

(22) PCT Filed: Jun. 28, 2002

(86) PCT No.: PCT/EP02/07190

§ 371 (c)(1),
(2), (4) Date: Jun. 21, 2004

(87) PCT Pub. No.: WO03/003524

PCT Pub. Date: Jan. 9, 2003

(65) Prior Publication Data

US 2004/0235366 A1 Nov. 25, 2004

(30) Foreign Application Priority Data

Jun. 29, 2001 (FR) ..... 01 08840

(51) Int. Cl.
*H01R 13/11* (2006.01)

(52) U.S. Cl. ..... 439/851; 439/857

(58) Field of Classification Search ..... 439/851, 439/852, 853, 854, 856, 857
See application file for complete search history.

(56) References Cited

U.S. PATENT DOCUMENTS

| | | | | |
|---|---|---|---|---|
| 4,540,233 A | | 9/1985 | Saijo et al. | |
| 4,564,259 A | * | 1/1986 | Vandame | 439/852 |
| 5,897,405 A | * | 4/1999 | Endo | 439/852 |
| 5,941,741 A | * | 8/1999 | Dobbelaere et al. | 439/852 |
| 5,951,339 A | * | 9/1999 | Chaillot et al. | 439/852 |
| 6,203,385 B1 | | 3/2001 | Sato et al. | 439/852 |
| 6,524,142 B1 | * | 2/2003 | Heimueller | 439/852 |
| 6,579,132 B1 | * | 6/2003 | Sato et al. | 439/852 |
| 2005/0026513 A1 | * | 2/2005 | Mulot | 439/852 |

FOREIGN PATENT DOCUMENTS

| | | |
|---|---|---|
| EP | 0310487 A1 | 4/1989 |
| FR | 2725835 A1 | 4/1996 |
| FR | 2769413 A1 | 4/1999 |

* cited by examiner

*Primary Examiner*—Xuong Chung-Trans
(74) *Attorney, Agent, or Firm*—Harrington & Smith, LLP

(57) ABSTRACT

The invention concerns a single-piece folded cut out female electric contact (1) comprising longitudinally a rear zone to be connected to an electric conductor, a protective cage comprising a floor (4), two side walls (5, 6), and, on the front, a contact terminal with a matching male contact, the contact terminal comprising at least an elastic contact blade (8, 9) provided with a terminal part (10, 11) oriented towards the front of the contact, the side walls (5, 6) being laterally adjacent to the floor and folded back along a longitudinal axis, the elastic contact blade being made from a lamination connected to the rear of a side wall and extending before being folded towards the rear of the contact.

17 Claims, 4 Drawing Sheets

FEMALE ELECTRIC CONTACT

FIELD OF THE INVENTION

The invention concerns a female electrical contact and particularly an electrical contact of the type comprising a zone of connection to an electrical conductor and a contact terminal to a complementary male contact.

BACKGROUND OF THE INVENTION

A number of female electrical contacts are known, particularly contacts in which the contact terminal to a complementary contact comprises spring contact tines arranged in the interior of a protective structure that forms a protective housing either completely around the tines or partially around the front or the back of the tines.

A known female electrical contact of the one-piece [monobloc] type with a protective housing is described, for example, in the document EP 0 310,487. This one-piece contact is formed from a single metal flank and comprises two contact tines that are bent back from top elements of the housing by a bend of 180° along axes that are parallel to the main axis of the contact, the tines thus comprising connecting parts to the top element that conform to the internal profile of the housing in the region of the top element and of the side walls of the housing.

SUMMARY OF THE INVENTION

In this contact, pretensioning retainer flaps of the spring contact tines and of the guide of the complementary male contact are made by bending from the front of the side walls of the housing.

This contact affords a very good protection of the contact tines and a considerable rigidity of the housing, but it necessitates a considerable width of metal strip in order to produce it.

An embodiment subsequent to the patent EP 0 310,487 is also described in the document FR 2,751,793. This embodiment is constructed in a longitudinal direction from a single flank and comprises, through the forward extension of the bottom in front of the tines, a structure that, once it is bent back along an axis that is perpendicular to the longitudinal axis of the contact, forms a front wall, this front wall being perforated in order to form a frame provided with pretensioning flaps of the contact tines and being extended by the elements of the protective housing of the contact tines that comprise zones of support for the locking tabs coming from the box.

Such an embodiment, for which elements of the housing wall that comprise zones of support for the locking tabs coming from the box are connected to the body of the contact through thin arms that are bent in the region of the tops of a frame, introduces a risk of breakage of these arms and considerable constraints in the region of these arms, particularly in the case of contacts used in automobile applications, for which a contact section of the order of one to four square millimeters is common.

In addition, a full protection of the tines by bending back an extended structure from the front to the rear leads to an increase in the width of the metal strip used and to a considerable increase in the operation of cutting and bending tools, which can limit the speed of fabrication and can introduce flaws in uniformity and quality into the contacts obtained.

In a manner so as to ensure a good protection of the contact tines in their entirety, while maintaining a large rigidity of contact, the invention proposes a cut and bent, one-piece, female electrical contact comprising, in the longitudinal direction, a rear zone of connection to an electrical conductor, a protective housing comprising a bottom, two side walls, and, on the front, a contact terminal with a complementary male contact, the contact terminal comprising at least one spring contact tine provided with a terminal part pointed towards the front of the contact, the side walls adjoining the bottom and folded back along a longitudinal axis, a contact for which said spring contact tine is constructed from a small strip that is joined to the rear of a side wall of the housing and extends toward the back prior to bending.

Advantageously, the tine is made up of a small strip cut on the bias with respect to the bottom.

The contact can include a retainer flap for pretensioning the terminal part of the tine, this flap being bent back from the front of a side wall of the housing.

Advantageously at least one of the side walls is extended by a flank designed to form a top by bending along the longitudinal axes, the housing thus having four sides.

More specifically, the contact can comprise the means of retention in a contact carrier box; these means can include either at least one opening introduced into a side wall or at least one tab constructed on one of the sides of the housing.

Preferably, the contact comprises two spring contact tines facing one another.

Advantageously, the contact tines are set down along an axis that is not perpendicular to the longitudinal axis of the contact. Alternatively, the tines are set down along a perpendicular axis and then warped in order to extend parallel to the longitudinal axis of the contact.

After bending, the tines can comprise, from the back toward the front, a support section against the lateral face to which they are connected, one section at a distance from the lateral face, a convex section forming a contact zone and a terminal support section of a flap placed in front of the lateral face to which they are connected.

In one particular embodiment of the invention, at least one of the side walls is extended by a flank designed to form a top by bending along at least one longitudinal axis, this flank being extended toward the back by a tab designed, after bending, to form a support wall for a complementary locking element set back from the bending zones of the tines.

BRIEF DESCRIPTION OF THE DRAWINGS

The invention will be better understood by reading the description that follows of non-limiting examples of embodiment of contacts in accordance with the invention, referring to the figures, which represent.

DETAILED DESCRIPTION OF THE INVENTION

Figures 1, 2:
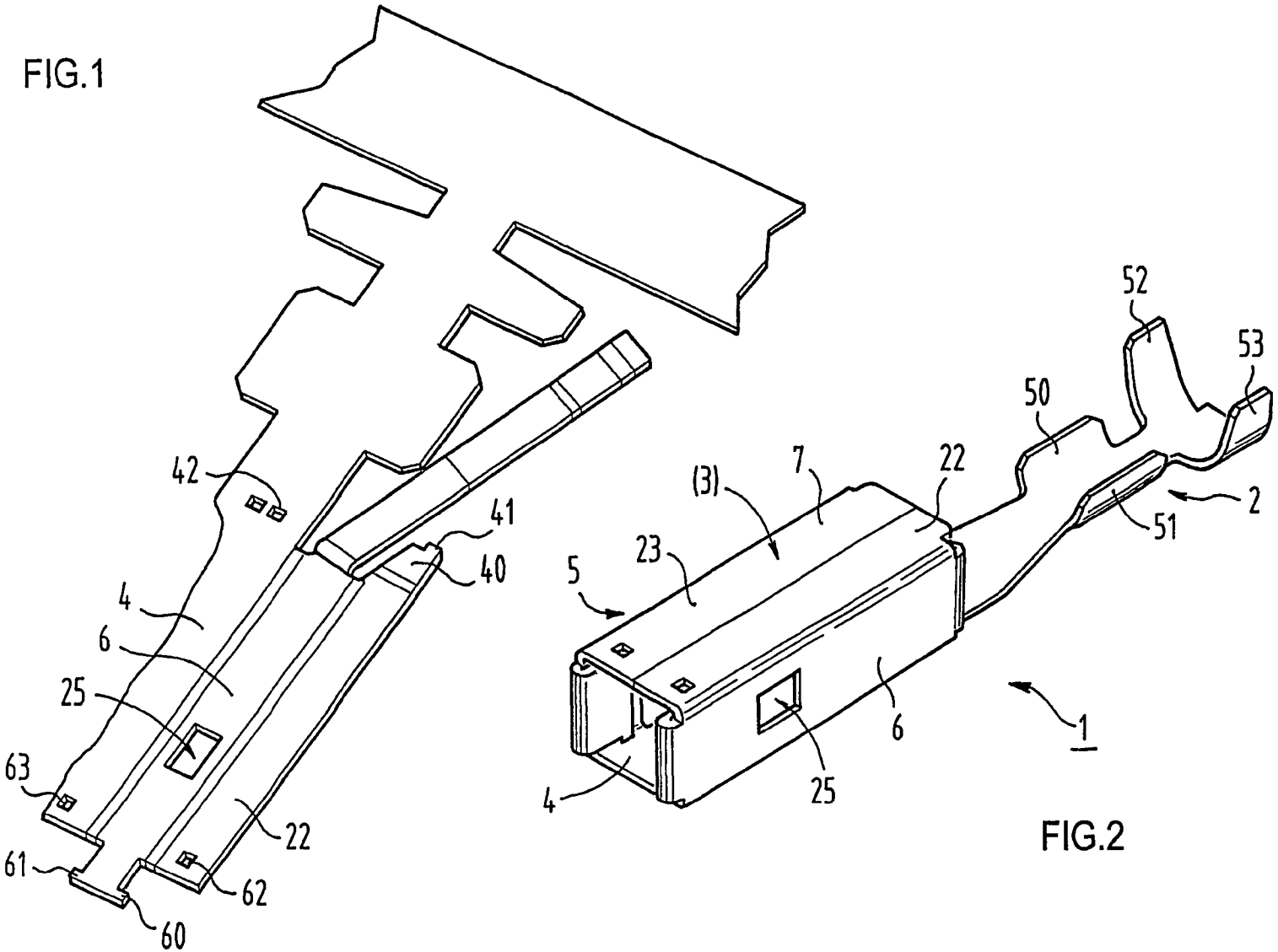
In FIG. 1: A view of an element made of metal strip, after cutting and before bending, intended to embody a first example of the contact in accordance with the invention.
In FIG. 2: A perspective view from the front of a first example of the contact in accordance with the invention.

The female electrical contact 1 shown in FIG. 2, by way of example, is of the cut and bent, one-piece type comprising, in the longitudinal direction, a rear zone 2 of connection to an electrical conductor. Even though other types of connection, such as a stripped insulation terminal or a soldered tab, are conceivable, the zone represented here is of the type that is crimped with the crimp tabs 50, 51 on a stripped end of a conductor and with the crimp tabs 52, 53 on the insulator of the conductor.

Figures 3, 4:
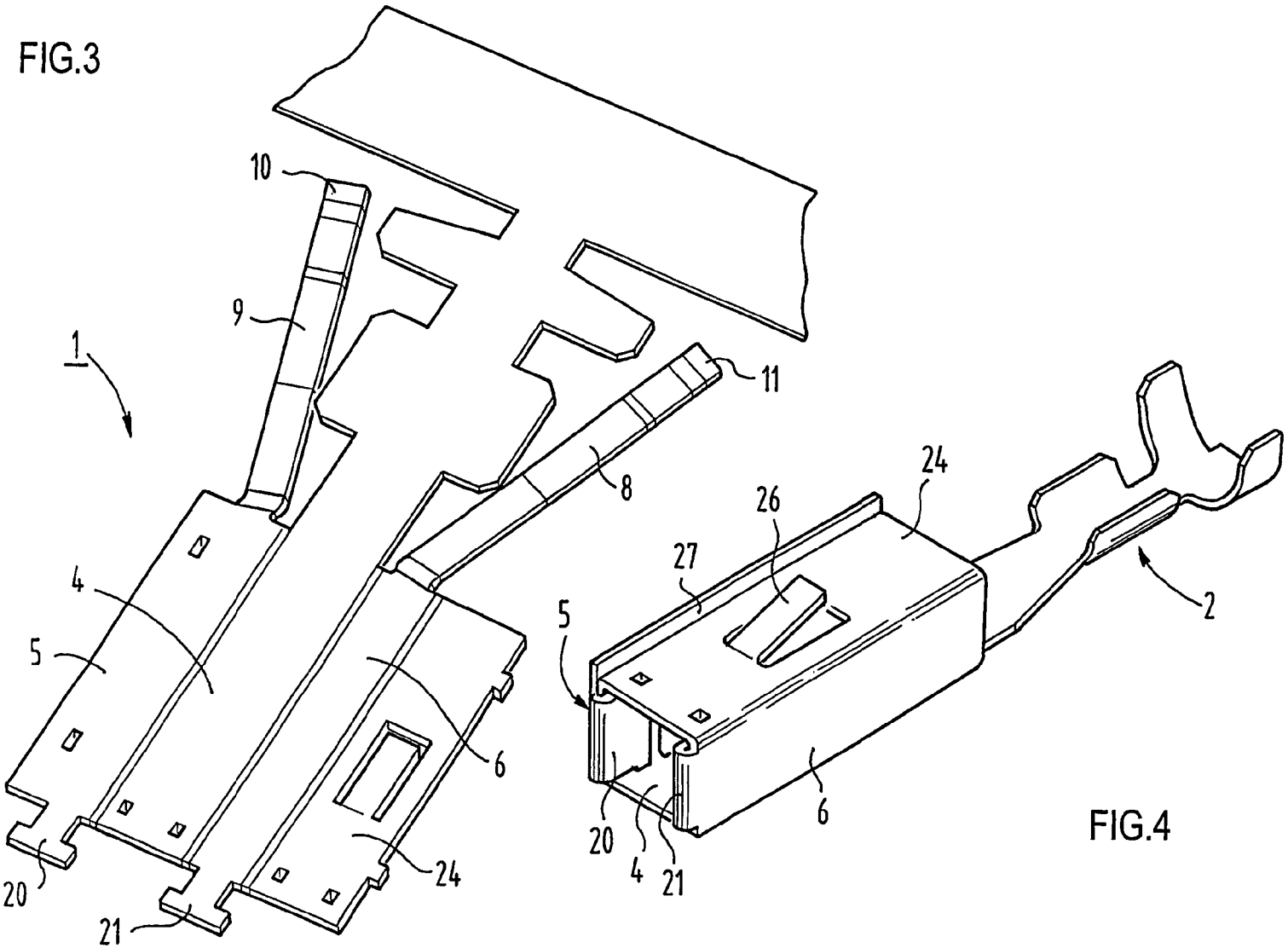
In FIG. 3: A view of an element made of metal strip, after cutting and before bending, intended to embody a second example of the contact in accordance with the invention.
In FIG. 4: A perspective view from the front of a second example of the contact in accordance with the invention.
Figure 5:
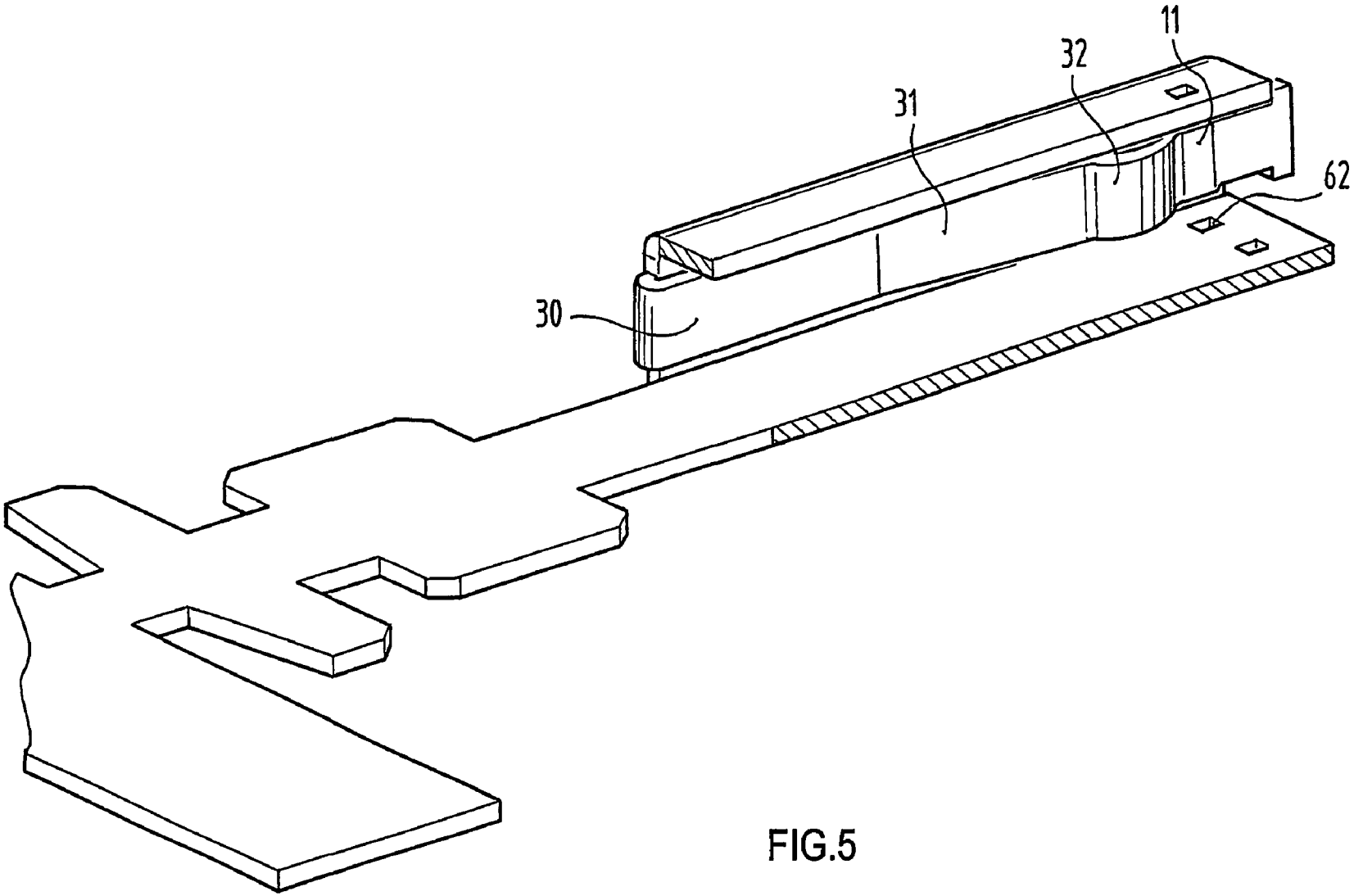
In FIG. 5: A section of a contact in accordance with the invention in a first phase of intermediate bending.

Joined to this zone of connection by a linking zone that is continuous with the bottom 4, the contact represented in FIG. 2 or 4 comprises a protective housing 3, which is comprised of the bottom 4, two side walls 5, 6, and a contact terminal to a complementary male contact, which is situated on the front and in the interior of the housing, the contact terminal being formed in the example shown by two spring contact tines 8, 9, each being provided with a terminal part 10, 11 pointed towards the front of the contact.

The contact is constructed from a single flank, as represented in FIGS. 1 and 3, for which the side walls 5 and 6 are side extensions adjoining the bottom along an axis that is transverse to the contact. In order to form the sides of the housing, the extensions are bent back along an axis that is parallel to the longitudinal axis of the contact.

Still according to FIGS. 1 to 3, relative to a contact furnished with two symmetrical contact tines facing one another, the spring contact tines are constructed from small strips connected to the back of the side walls and extend, prior to bending, toward the back and obliquely relative to the bottom. This arrangement minimizes the developed surface of the contact which permits minimizing wasted material during cutting and increasing the density of contacts by reducing the interval between contacts on the strip.

In order to construct the contact, since the tines, after oriented cutting, are situated towards the rear of the contact, the latter are set down from the rear towards the front. Due to the fact of their positioning on the bias, it is provided to bend them along an axis that is not perpendicular to the longitudinal axis of the contact, which permits rendering them back parallel to the longitudinal axis of the contact after bending. In order that these tines should not extend vertically beyond the side wall to which they are connected after bending, the tines have a width that is less than the height of the wall. The angle that the bending axis makes with an axis that is perpendicular to the longitudinal axis of the contact is one-half of the angle that the tine makes with the longitudinal axis of the contact prior to bending.

In order to avoid having a protuberance that is not perpendicular behind the housing in the region of the bending of the tines, it is possible to lay down the tines along an axis that is perpendicular to the longitudinal axis of the contact, then to warp the tines so that they extend parallel to the longitudinal axis of the contact.

After bending, the tines comprise, from back to front, a first section 30 supported against the lateral face to which they are connected. This section creates a double-wall zone with the corresponding side wall.

When this section 30 is extended, the tines present an intermediate section 31 at a distance from the lateral face. This section forms the spring part of the tine and influences the contact pressure to a complementary contact pin or prong. The zone of contact with the complementary contact is created by a convex section 32.

The contact tine is terminated toward the front by a terminal section 11 of support against a flap 20, 21, set in the front of the lateral face to which the tine is joined. The presence of this flap brings about a retaining and a pretensioning of the tine.

In the case of a contact with two tines according to the invention arranged facing one another, the flaps fix the minimum thickness of the pin or the prong received between the tines and control the minimum contact force of the tines. In addition, the flaps protect the contact tines and guide the pin during its introduction into the housing.

In order to rigidify the front of the housing and to maintain the flaps in a precise position, the latter can have pins 60, 61, which are intended to be received in the holes 62, 63 constructed in the bottom and in a top of the housing.

To terminate the housing, the latter includes a top 7, visible in FIGS. 2 and 4. In FIGS. 3 and 4, it is described that the top is made entirely from the side wall 6 of the contact, this wall being extended by a flank 24 forming the top 7 by bending along a longitudinal axis, the housing thus having four sides. In this embodiment, it is possible to provide, in a known manner, a flange 27 for polarization of the contact and protection of a locking tab 26 of the contact in a receiving socket of an insulating box. This flange is thus formed by an extension of the side wall 5. During the closing of the housing, it is possible to firmly join the wall 5 and the top 24 by soldering or by a pin device, as known in the field.

The means of maintaining the contact in the insulating receiving box of this contact can include at least one opening 25 introduced on one of the sides of the housing or, as described above, at least one tab 26 constructed on one of the sides of the housing.

The opening or the openings can be located on the side walls of the housing behind the tines; the tab or the tabs can be situated on one face or on any of several faces of the housing.

The top 7 can also be constructed in two parts 22, 23, each of the two parts being constructed by lateral extension of the side walls 5, 6. This configuration corresponds to FIGS. 1 and 2.

Figure 6:
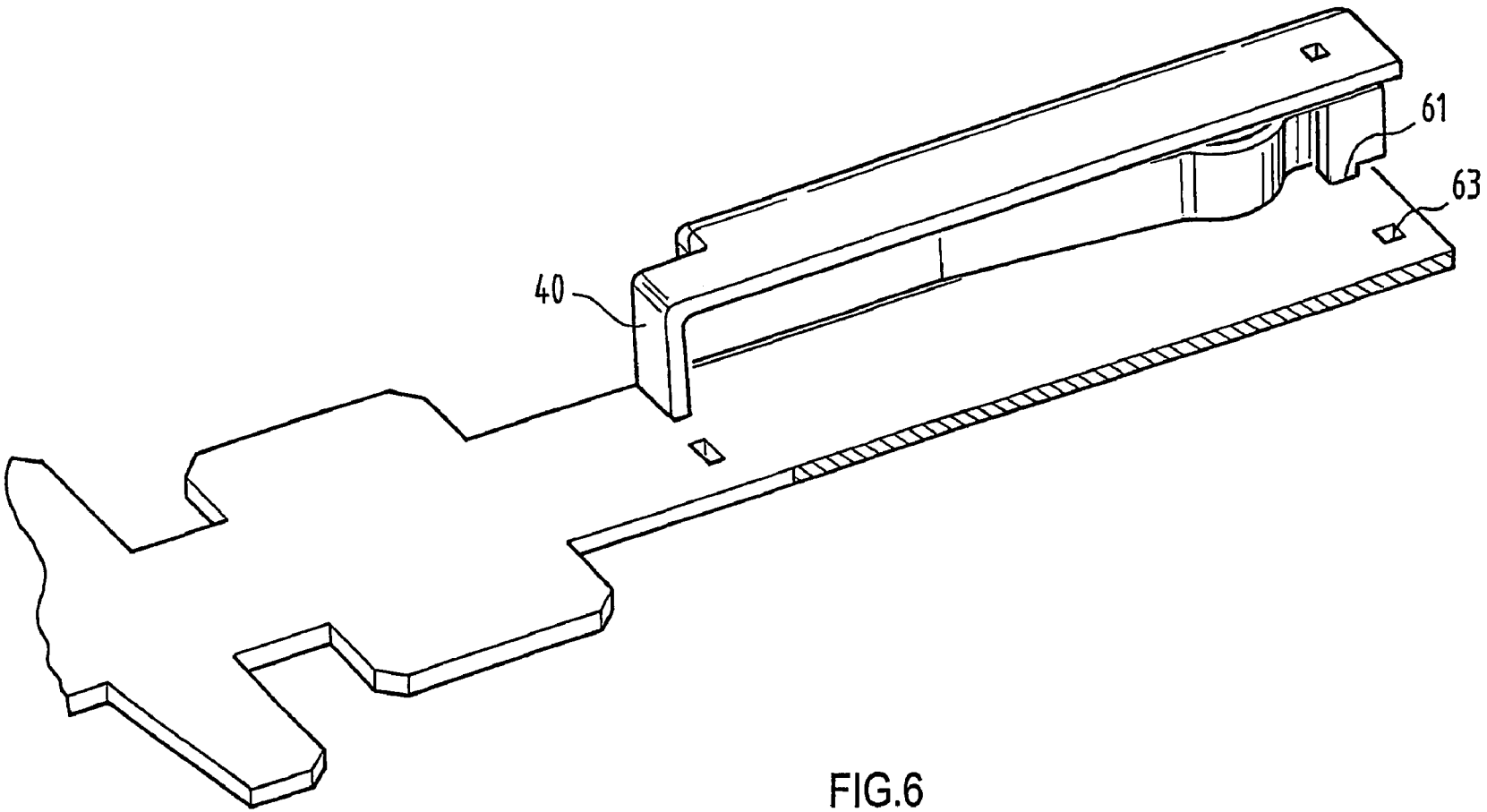
In FIG. 6: A section of a contact in accordance with the invention in a second phase of intermediate bending.

Particularly visible in FIG. 6, for the purpose of creating a support surface for a secondary locking element (not shown) such as a rod crossing through the box transversely, a tab 40 is provided by extending toward the back a top element on the flank making up the contact. This tab, which may be furnished with a pin 41 designed to be fit in a cutout 42 is found after bending back the feet of the tines and protects these feet.

The invention is not limited to the examples described in the figures and applies, in particular, to an electrical contact provided with any rear zone of connection and can be applied to a contact for which a single tine is arranged toward the back.

The invention claimed is:

1. A cut and bent, one-piece, female electrical contact comprising, in the longitudinal direction, a rear zone adapted for connection to an electrical conductor, a protective housing comprising a bottom, two side walls, and, on a front of the protective housing, a contact terminal adapted for contacting a complementary male contact, wherein the contact terminal comprising at least one spring contact tine provided with a terminal part pointed towards a front of the contact, wherein the side walls each laterally adjoin the bottom and are bent along a longitudinal axis, wherein each side wall comprises a front side and a rear side, and wherein the at least one spring contact tine is constructed from a small strip that extends directly from the rear side of at least one of the side walls and extends in a general rearward direction towards a back of the contact prior to bonding from the rear side of the at least one side wall.

2. The electrical contact according to claim 1, further characterized in that the tine is created from a small strip cut on an angle relative to the bottom.

3. The female contact according to claim 1, further comprising at least one flap for maintaining a pretensioning of the terminal part of the tine, wherein the at least one flap being bent back from a front of at least one of the side walls.

4. The female contact according to claim 1, further characterized in that at least one of the side walls is extended by a flank designed to form a top by bending along at least one longitudinal axis, the housing thus having four sides.

5. The female contact according to claim 1, further characterized in that the contact tines are set down along an axis that is not perpendicular to the longitudinal axis of the contact.

6. The female contact according to claim 1, further characterized in that the tine is set down along a perpendicular axis, then warped so as to extend parallel to the longitudinal axis of the contact.

7. The female contact according to claim 1, further characterized in that said tine, after bending, comprises from back to front a first section supported against the lateral face to which it is connected, an intermediate section at a distance from the lateral face, a convex section forming a contact zone and a terminal section of support against a flap set down at a front of the lateral face to which it is connected.

8. The female contact according to claim 1, further characterized in that it comprises two of the tines facing one another.

9. The female contact according to claim 1, further characterized in that since at least one of the side walls is extended by a flank designed to form a top by bending along at least one longitudinal axis, this flank is extended toward the back by a tab designed, after bending, to form a support wall of a complementary locking element set back from the bending zones of the tines.

10. The female contact according to claim 1, further characterized in that it comprises means for retention in a contact carrier box.

11. The female contact according to claim 10, further characterized in that the retaining means comprise at least one opening created on one of the sides of the housing.

12. The female contact according to claim 10, further characterized in that the retaining means comprise at least one tab constructed on one of the sides of the housing.

13. A cut and bent, one-piece, female electrical contact comprising:

a connection zone at a rear of the contact adapted for connection to an electrical conductor; and a protective housing connected to the connection zone, wherein the protective housing comprises a bottom, two side walls, and a contact terminal, wherein the contact terminal is adapted for contacting a complementary male contact inserted into the protective housing, wherein the contact terminal comprises at least one spring contact tine, wherein the at least one spring contact tine each comprise a terminal part pointed towards a front of the contact, wherein each side wall comprises a front side edge and a rear side edge, wherein the at least one spring contact tine comprises a strip which extends directly from a rear side edge of at least one of the side walls and is bent towards the front of the contact, and wherein prior to bending of the at least one tine the at least one tine extends in a general rearward direction towards a back of the contact from the rear side edge of the at least one side wall.

14. A female electrical contact as in claim 13 wherein the at least one spring contact tine comprises two of the tines extending respectively from the rear edges of two of the side walls.

15. A female electrical contact as in claim 13 wherein the at least one spring contact tine extends obliquely relatire to the bottom from the rear side edge of the at least one side wall.

16. A cut and bent, one-piece, female electrical contact comprising:

a connection zone at a rear of the contact adapted for connection to an electrical conductor; and a protective housing connected to the connection zone, wherein the protective housing comprises a bottom, two side walls, and two contact terminals, wherein the contact terminals are adapted to contact a complementary male contact inserted into the protective housing, wherein the contact terminals each comprise a spring contact tine, wherein the spring contact tines each comprise a terminal part pointed towards a front of the contact, wherein each side wall comprises a front side edge and a rear side edge, wherein the contact terminals each comprise a strip which extends directly from the rear aide edge of a respective one of the side walls and is bent towards the front of the contact at a bend, wherein the tines extend in a general rearward direction from the rear side edge of the side walls prior to bending of the tines towards the front of the contact, and wherein the bend is about 180 degrees.

17. A female electrical contact as in claim 16 wherein the spring contact tines extend obliquely relative to the bottom from the rear side edge of the side walls.

* * * * *

UNITED STATES PATENT AND TRADEMARK OFFICE

CERTIFICATE OF CORRECTION

PATENT NO. : 7,223,134 B2
APPLICATION NO. : 10/481930
DATED : May 29, 2007
INVENTOR(S) : Chaillot It is certified that error appears in the above-identified patent and that said Letters Patent is hereby corrected as shown below:

IN THE CLAIMS:

Claim 1, Column 5, line 2 delete “bonding” and replace with --bending--.

Claim 16, Column 6, line 41 delete “aide” and replace with --side--.

Signed and Sealed this

Twenty-fourth Day of July, 2007

JON W. DUDAS
*Director of the United States Patent and Trademark Office*